US007559162B2

(12) United States Patent
Bierwith

(10) Patent No.: US 7,559,162 B2
(45) Date of Patent: Jul. 14, 2009

(54) LIP ASSEMBLY INCLUDING SIDE PORTIONS WITH PROJECTIONS

(76) Inventor: Robert S. Bierwith, 1331 Eastshore Hwy., Berkeley, CA (US) 94710

( * ) Notice: Subject to any disclaimer, the term of this patent is extended or adjusted under 35 U.S.C. 154(b) by 174 days.

(21) Appl. No.: 11/094,337

(22) Filed: Mar. 29, 2005

(65) Prior Publication Data

US 2005/0241195 A1 Nov. 3, 2005

Related U.S. Application Data

(60) Provisional application No. 60/565,233, filed on Apr. 23, 2004.

(51) Int. Cl.
*E02F 3/40* (2006.01)

(52) U.S. Cl. ..... 37/444; 37/448; 172/701.3

(58) Field of Classification Search ..... 37/444, 37/450, 455, 448; 172/701.3
See application file for complete search history.

(56) References Cited

U.S. PATENT DOCUMENTS 1,824,989 A * 9/1931 Fundom ..... 37/398
1,975,625 A * 10/1934 St. Louis ..... 37/398
2,325,336 A * 7/1943 Mikan ..... 37/398
4,018,861 A 4/1977 Bierwith
4,360,981 A 11/1982 Bierwith et al.
4,413,432 A 11/1983 Bierwith
4,570,365 A 2/1986 Bierwith
4,579,494 A 4/1986 Bierwith
4,716,667 A * 1/1988 Martin ..... 37/453
5,052,134 A 10/1991 Bierwith
5,077,918 A * 1/1992 Garman ..... 37/452
5,134,793 A 8/1992 Bierwith
5,417,518 A 5/1995 Bierwith
5,526,592 A 6/1996 Bierwith
5,680,717 A 10/1997 Bierwith
6,032,390 A 3/2000 Bierwith
6,151,812 A 11/2000 Bierwith
6,216,368 B1 4/2001 Bierwith
6,393,738 B1 5/2002 Bierwith
6,415,533 B2 7/2002 Bierwith
6,561,108 B2 * 5/2003 Fisher ..... 111/101
D478,599 S * 8/2003 Zaayman et al. ..... D15/32
6,652,186 B2 11/2003 Bierwith
6,668,472 B2 12/2003 Bierwith
6,675,509 B2 1/2004 Bierwith
6,751,897 B2 6/2004 Bierwith
6,952,892 B1 10/2005 Bierwith
D537,846 S * 3/2007 Block ..... D15/32
2001/0020342 A1 9/2001 Bierwith
2002/0133986 A1 9/2002 Bierwith
2003/0037467 A1 2/2003 Bierwith (Continued)

*Primary Examiner*—Gary S. Hartmann
(74) *Attorney, Agent, or Firm*—Townsend and Townsend and Crew, LLP

(57) ABSTRACT

A lip assembly is disclosed and includes a lip having an upper surface, a lower surface, a front portion, a rear portion, a first side portion, a second side portion, and a plurality of holes disposed between the front portion and the rear portion and extending from the upper surface to the lower surface. The first and second side portions are on opposite sides of the front portion of the lip, and the front portion, the first side portion, and the second side portion include projections and valleys. Tooth assemblies extend away from at least the front portion of the lip and are respectively coupled to the lip via the plurality of holes.

12 Claims, 7 Drawing Sheets

U.S. PATENT DOCUMENTS

2003/0063951 A1 4/2003 Bierwith
2003/0093928 A1 5/2003 Bierwith
2005/0229443 A1 10/2005 Bierwith

* cited by examiner

LIP ASSEMBLY INCLUDING SIDE PORTIONS WITH PROJECTIONS

CROSS REFERENCE TO RELATED APPLICATIONS

This application claims benefit under 35 U.S.C. 119(e) of U.S. Provisional Patent Application No. 60/565,233, filed Apr. 23, 2004, which is herein incorporated by reference in its entirety for all purposes.

BACKGROUND OF THE INVENTION

Many large excavators are provided with bucket assemblies. The bucket assemblies can be used to remove earth, tar sand, etc. In a typical excavator, a lip is welded to an edge of a bucket body. The lip, viewed head-on or looking into the bucket, may be skewed rearwardly at its two opposite ends. Chisel-shaped excavating teeth are coupled to the lip and are used for digging. The lip can have a means for removably securing the teeth to the lip so that worn or damaged teeth can be replaced. Damaged or worn teeth should be replaced to avoid damage to the lip and the bucket body and to maintain the effectiveness of the bucket assembly.

A lip is described in U.S. Pat. No. 6,751,897 (U.S. patent application Ser. No. 10/054,332, filed on Nov. 13, 2001) by the same inventor as the present application. A number of improvements could be made to the lip. The sides of the lip in the patent application have straight edges and lip shrouds are attached to the straight edges. The lip shrouds do not have much penetration ability and mainly serve to protect the sides of the lip.

It would be desirable to protect the sides of the lip, and to also use the sides of the lip to help penetrate a material being excavated along with the front of the lip. Embodiments of the invention address these and other problems.

SUMMARY OF THE INVENTION

Embodiments of the invention are directed to lip assemblies, and in particular, lip assemblies for excavation bucket assemblies.

One embodiment of the invention is directed to a lip assembly comprising: a lip having an upper surface, a lower surface, a front portion, a rear portion, a first side portion, a second side portion, and a plurality of holes disposed between the front portion and the rear portion and extending from the upper surface to the lower surface, wherein the first and second side portions are on opposite sides of the front portion of the lip, and wherein the front portion, the first side portion, and the second side portion include projections and valleys; and a plurality of tooth assemblies extending away from at least the front portion of the lip and respectively coupled to the lip via the plurality of holes.

Another embodiment of the invention is directed to an excavation bucket assembly using the above-described lip assembly.

These and other embodiments are described in further detail below.

DETAILED DESCRIPTION

Embodiments of the invention are directed to lip assemblies and excavation bucket assemblies including lip assemblies. The excavation bucket assemblies and lip assemblies according to embodiments of the invention can be used in a variety of industries including the mining and construction industries. They may be used with any suitable excavation apparatus. Examples of excavation apparatuses, which use the bucket assemblies and lip assemblies include backhoes, power shovels, front-end loaders, dragline equipment, etc.

In a typical bucket assembly, a bucket body can be coupled to a lip assembly. The bucket body may have a rear wall, sidewalls and a bottom wall to contain an excavated material. The lip assembly can be coupled to a front portion of the bucket body to form a bucket assembly. The lip assembly may have a lip, a plurality of tooth assemblies, and a plurality of lip shrouds. The lip shrouds and the tooth assemblies can be coupled to the front portion of the lip, and the plurality of lip shrouds can be interspersed between the adjacent tooth assemblies in the plurality of tooth assemblies.

The lip of the lip assembly may be of any suitable size or configuration. For example, the lip may be generally U-shaped. The lip includes a first side portion and a second side portion, as well as a front portion and a rear portion. Curved corner regions may be between the first side portion and the front portion and also between the second side portion and the front portion. The side portions may be skewed rearwardly in relation to the front portion of the lip, and the distance between the side portions may span several yards in some embodiments. Although the lip may have any suitable thickness, the thickness of the lip can be on the order of five inches or more (e.g., 5.5 inches). When used, the rear portion of the lip would typically be mounted to the front edge of an excavation bucket body (not shown) to form an excavation bucket assembly. Welding can be used to mount the rear portion of the lip to the front edge of the excavation bucket body.

Figure 1:
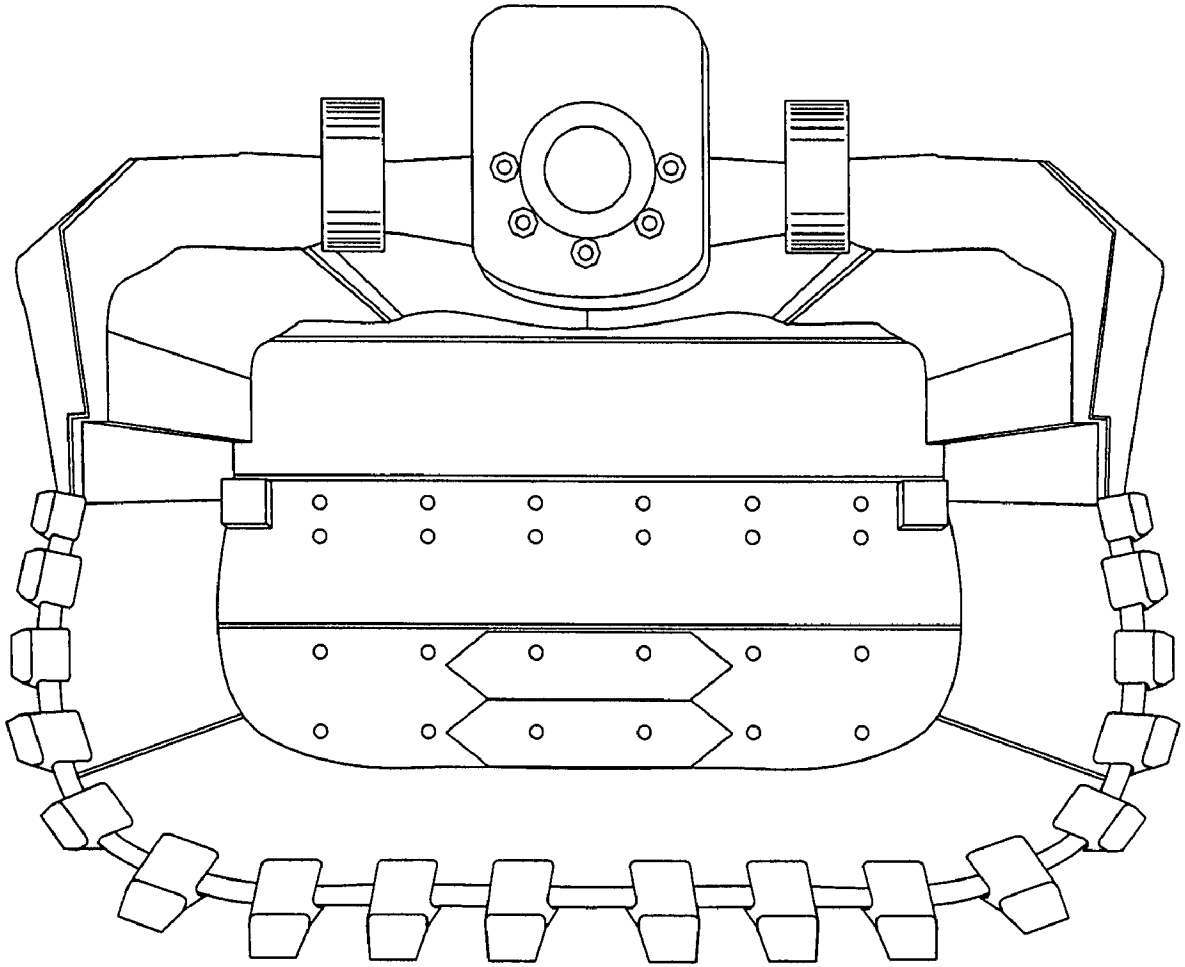
FIG. 1 shows a front view of an excavation bucket assembly including a lip assembly according to an embodiment of the invention.

FIG. 1 shows a front view of an excavation bucket assembly. As shown, the front portion of the excavation bucket assembly includes a lip assembly. The lip assembly includes a plurality of tooth assemblies, and the side portions have lip shrouds on them. As shown in FIG. 1, the shroud-covered side portions of the lip and the tooth assemblies at the front of the lip in the lip assembly can be used to penetrate a material to be excavated. The entire surface of the lip can be used for excavation. In addition, the lip assembly has a low profile.

Figure 2:
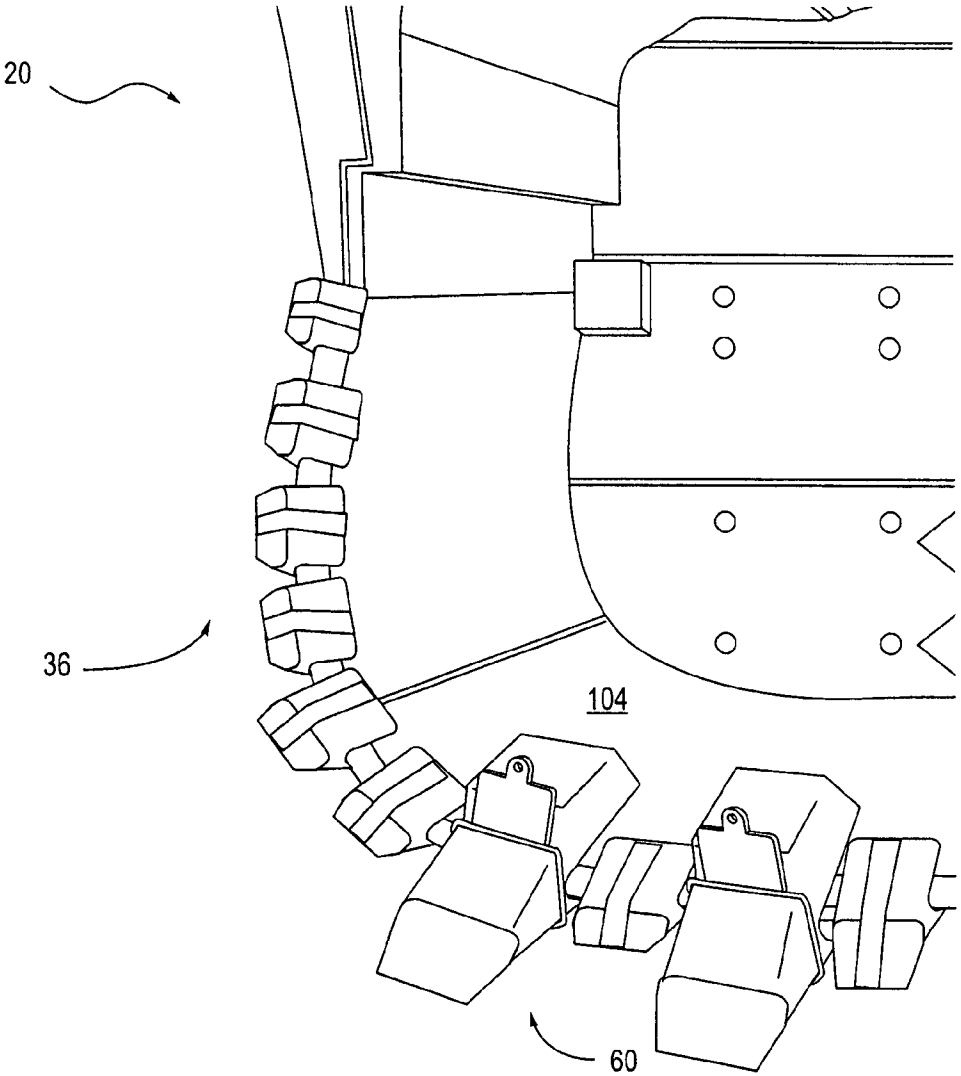
FIG. 2 shows a close up view of a corner region and sides of a lip assembly.

FIG. 2 shows a close up view of a lip assembly. The lip assembly includes a lip including a corner region 104 that is curved. Lip shrouds 36 cover projections (not shown) on the lip and resemble teeth which can be used to penetrate a material that is to be excavated.

Figure 3:
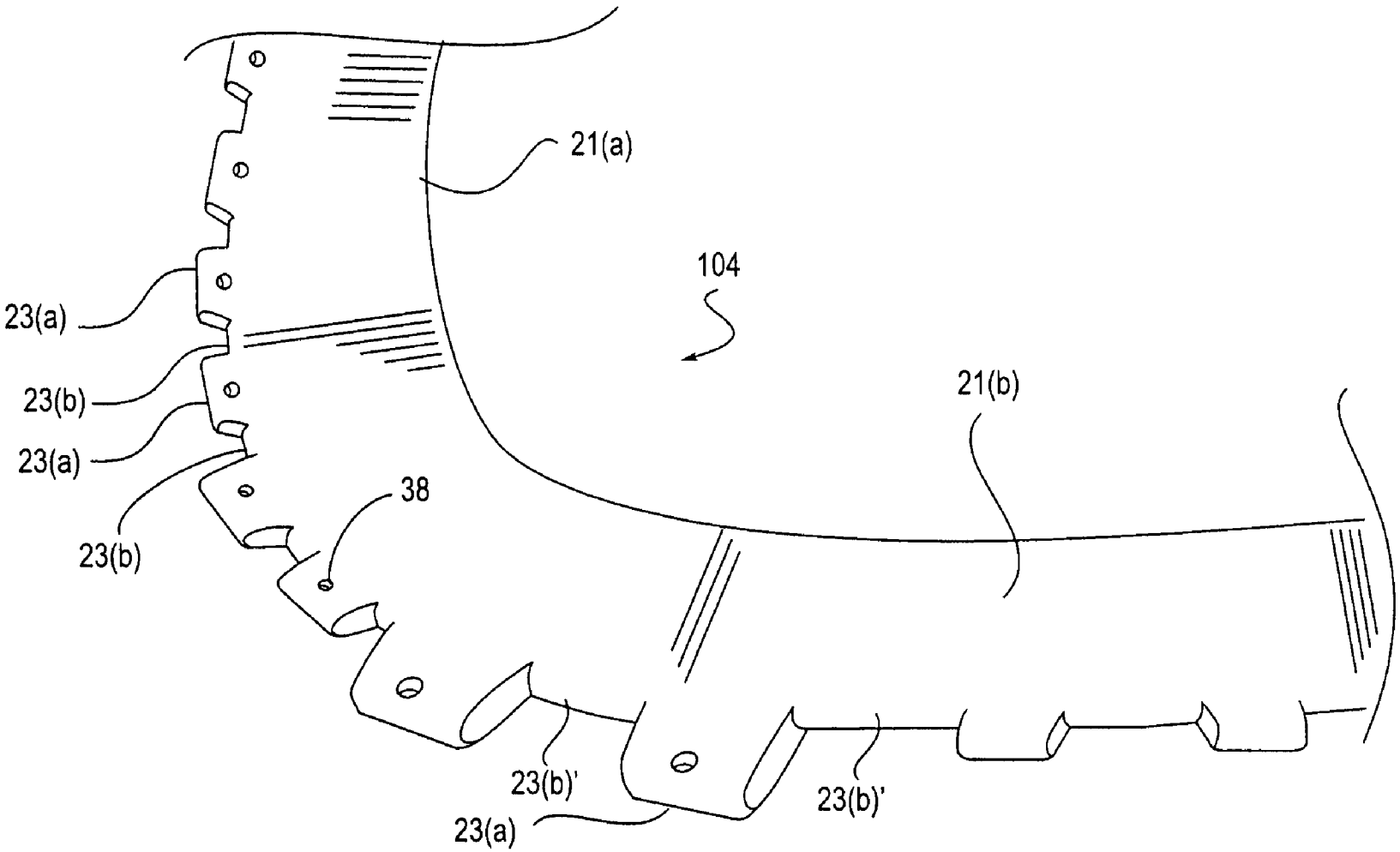
FIG. 3 shows a schematic view of a curved corner region of a lip without lip shrouds on the lip.

FIG. 3 shows a schematic illustration of a lip. The lip includes a curved corner region 104 between a side portion 21(*a*) and an intermediate portion 21(*b*) including a front portion and a rear portion. A number of projections 23(*a*) and valleys 23(*b*) are present at the corner region 104 and on the side portion 21(*a*). The projections 23(*a*) support the previously described lip shrouds and can be used to space them apart at a suitable pitch. The projections may be formed by forging steel. Holes 38 can be present in the vicinity of each projection 23(*a*). Coupling devices such as pins may be used to couple the lip shrouds to the projections. Other projections 23(*a*) and valleys 23(*b*)' are present in the intermediate portion 21(*b*) of the lip. The valleys 23(*b*)' at the intermediate portion 21(*b*) of the lip can hold tooth assemblies. This is described in further detail below.

It is not intuitive to create projections on the side regions of a lip or at the corner regions of a lip. Integral projections can form stress-risers, which can potentially cause cracks. In general, one would not want to form protrusions at the corners of large metal structures, because stress is induced at the corners. However, the present inventor has discovered that it is possible to put these protrusions on the lip at the corner regions and on the sides if a gradual curvature is present at the corner regions of the lip. Such stress concerns are present, especially when heavy material is being excavated. If the lip cracks, then the lip must be replaced or fixed. Replacing or fixing lips is expensive. In embodiments of the invention, the design of the lip is also relatively simple and no additional welding or attachment of additional supports is needed.

Figure 4:
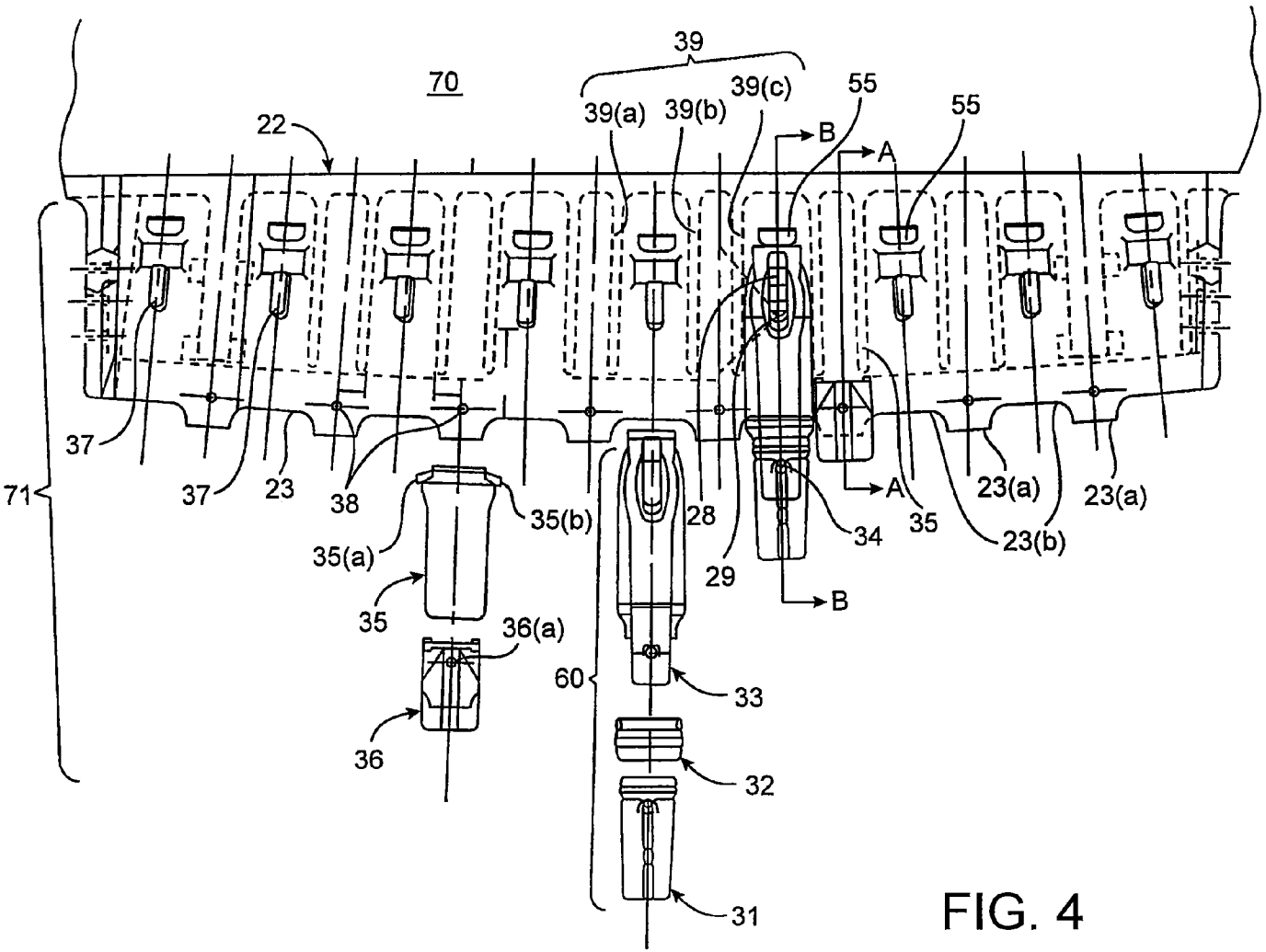
FIG. 4 shows a top plan view of a front portion and a rear portion of a lip assembly.

FIG. 4 shows a portion of an excavation bucket assembly with a lip assembly 71 according to an embodiment of the invention. A front portion of a bucket body 70 is coupled to a rear portion 22 of the lip assembly 71. Coupling may occur in any suitable manner. For example, in preferred embodiments, the lip 20 of the lip assembly 71 is welded to the front portion of the bucket body 70.

The lip assembly 71 includes a lip 20 with a front portion 23 and a rear portion 22. The front portion 23 includes a number of projections 23(*a*) and valleys 23(*b*) producing an undulating profile when viewed from the top. Tooth assemblies 60 are mounted over the valleys 23(*b*) and between the projections 23(*a*), while lip shrouds 36 are mounted over the projections 23(*a*) and between the valleys 23(*b*). The lip shrouds 36 protect the lip 20 during digging. Like the teeth 31, the lip shrouds 36 can be replaced periodically when they become worn or damaged. Protective wearplates 35 with edge regions 35(*a*), 35(*b*) may be disposed on the upper surface of the lip 20 to protect the upper surface of the lip 20. Adjacent block members 55 on opposite sides of a wearplate 35 may secure the edge regions 35(*a*), 35(*b*) of a wearplate 35 to the upper surface of the lip 20. The block members 55 are respectively positioned at the ends of the adaptors 33 and the tooth assemblies 60 mounted on the lip 20. The block members 55 can inhibit the lateral movement of the adaptors 33 and the tooth assemblies 60 and extend their working life. Most or all of the parts of the excavation bucket assembly and the lip assembly can be made of a hard metal alloy such as steel.

A first plurality of holes 37 is present between the front portion 23 and the rear portion 22 of the lip 20. In this example, the first plurality of holes 37 consists of a generally straight line of holes. Each of the holes from the first plurality of holes 37 extends from an upper surface of the lip 20 to the lower surface of the lip 20. Each of the holes from the first plurality of holes 37 may also have any suitable shape. For example, each of the holes from the first plurality of holes 37 in this example each has an oblong shape.

A plurality of tooth assemblies 60 may be respectively coupled to the lip 20 via the first plurality of holes 37 using any type of securing mechanism. For example, a C-clamp 28, a locking wedge 29, and a wedge block (not shown) combination may be used to secure the tooth assembly 60 to the lip 20. When the tooth assemblies 60 are secured to the lip 20, the tooth assemblies 60 extend away from the lip 20.

A second plurality of holes 38 is located at the front portion 23 of the lip 20. Each of the holes of the second plurality of holes 38 lies between adjacent valleys 23(*b*). The second plurality of holes 38 may be in a generally straight line, and each of the holes 38 may have any suitable shape. For example, each of the holes from the second plurality of holes 38 in this example have a circular shape.

Lip shrouds 36 are secured to the lip 20 via the second plurality of holes 38 and over the projections 23(*a*). Each lip shroud 36 can have pair of legs, which are disposed on the upper and lower surfaces of the front portion of the lip 20 when the lip shroud 36 is mounted to the lip 20. Each lip shroud 36 may also optionally have sidewalls. The sidewalls and the legs may form a pocket in which the lip projections 23(*a*) are received. By providing sidewalls to the lip shrouds 36, the side-to-side movement of the lip shrouds 36 is restricted as the lip shrouds 36 conform to the shape of the respective lip projections 23(*a*). The likelihood that the lip shrouds 36 will contact adjacent tooth assemblies 60 is reduced, thus increasing the useful life of the tooth assemblies 60.

Each tooth assembly 60 comprises a tooth 31. Preferably, each tooth assembly 60 comprises a tooth 31, an adapter 33, and an adapter shroud 32. In these embodiments, the adapter shroud 32 covers a portion of the adapter 33 and is disposed between the adapter 33 and the tooth 31. When they are assembled together, holes in the tooth 31 and the adapter 33 are aligned and are secured together with a connector such as a pin (not shown). If the tooth 31 becomes worn, the tooth 31 can be replaced without replacing other parts of the tooth assembly 60. The connector can be removed along with the worn tooth and a new connector and tooth can be coupled to the adapter 33. Suitable tooth assemblies and other components are described in U.S. Pat. No. 5,526,592 and U.S. patent application Ser. No. 09/183,478, filed Oct. 29, 1998, both of which are herein incorporated by reference in their entirety.

Any suitable number of stabilizing members 39 may be present on the lip 20 at any suitable location. In the example shown in FIG. 4, for example, pairs of stabilizing members 39(*b*), 39(*c*) are disposed between adjacent holes from the first plurality of holes 37. Also, for each hole from the first plurality of holes 37, a pair of stabilizing members 39(*a*), 39(*b*) may be disposed adjacent to, and on opposite sides of the hole. The pair of stabilizing members 39(*a*), 39(*b*) on opposite sides of the hole inhibit the lateral movement of a tooth assembly 60 disposed between them. Contact with other adjacent structures (e.g., the lip shrouds) is inhibited, thus decreasing the wear on the components of the tooth assemblies 60. Furthermore, the stabilizing members 39 also provide extra support for the lip 20 itself so that the structural integrity of the lip 20 is increased in comparison to a lip without stabilizing members.

The stabilizing members 39 shown in FIG. 4 can be characterized as parallel ribs. This feature is described in detail in U.S. Pat. No. 6,751,897 (U.S. patent application Ser. No. 10/054,332, filed on Nov. 13, 2001), which is by the same inventor as the present application. When the ribs are disposed on opposite sides of a tooth assembly on the lip, the movement of the tooth assembly to both sides of the tooth assembly is restricted by the presence of the ribs. Embodiments of the invention, however, are not limited to those embodiments specifically shown in the Figures Other configurations or structures may be used to inhibit the lateral movement of the tooth assemblies. For example, in an alternative embodiment, instead of two ribs disposed between adjacent holes, only one rib can be present between adjacent holes from the first plurality of holes 37. In an another alternative embodiment, the stabilizing member could be a single block of material (e.g., a block of steel) between adjacent holes, instead of two ribs between adjacent holes. The block of material could inhibit the lateral movement of tooth assemblies disposed on both sides of the block.

The stabilizing members 39 may have any suitable spacing or orientation. Preferably, the stabilizing members 39 are ribs, which are parallel and extend in the same direction as the tooth assemblies 60. Stabilizing members 39 which are on opposite sides of a hole from the first plurality of holes 37 are preferably spaced so that they are adapted to receive a tooth assembly 60. For example, the spacing between two stabilizing members 39(*a*), 39(*b*) on opposite sides of a hole may be approximately equal to, or slightly greater than, the width of a tooth assembly 60 or an adapter 33 for a tooth assembly 60. The spaced stabilizing members 39(*a*), 39(*b*) can form a slot which is configured to receive a tooth assembly 60 or the adapter 33 for the tooth assembly 60. As shown in FIG. 2, the stabilizing members 39 extend from a rear portion 22 of the lip 20 towards the front portion 23 of the lip 20. The ends of the stabilizing members 39 preferably terminate short of the front portion 23 of the lip 20 (e.g., in a central region of the lip 20) or in the region where the adapter 33 lies. The lateral movement of each of the tooth assemblies 60 is inhibited by restricting the movement of a corresponding tooth assembly adapter 33 with the stabilizing members 39.

The stabilizing members 39 may be formed in any suitable manner. For example, the stabilizing members 39 may be separately formed. Then, the stabilizing members 39 may be welded onto the main body of the lip 20. In other embodiments, the stabilizing members 39 may be secured to the main body of the lip 20 via a securing mechanism such as a pin or a bolt.

The stabilizing members 39 are preferably disposed at least at the lower surface of the lip 20. By providing the stabilizing members 39 at the lower surface of the lip 20, the stabilizing members 39 will not obstruct the path of excavated material moving from the front portion of the lip 20 to the rear portion 22 of the lip 20 and into the bucket body 70. Also, as previously noted, the stabilizing members 39 also inhibit the lateral movement of the tooth assemblies 60 and improve the structural integrity of the lip 20.

Figure 5:
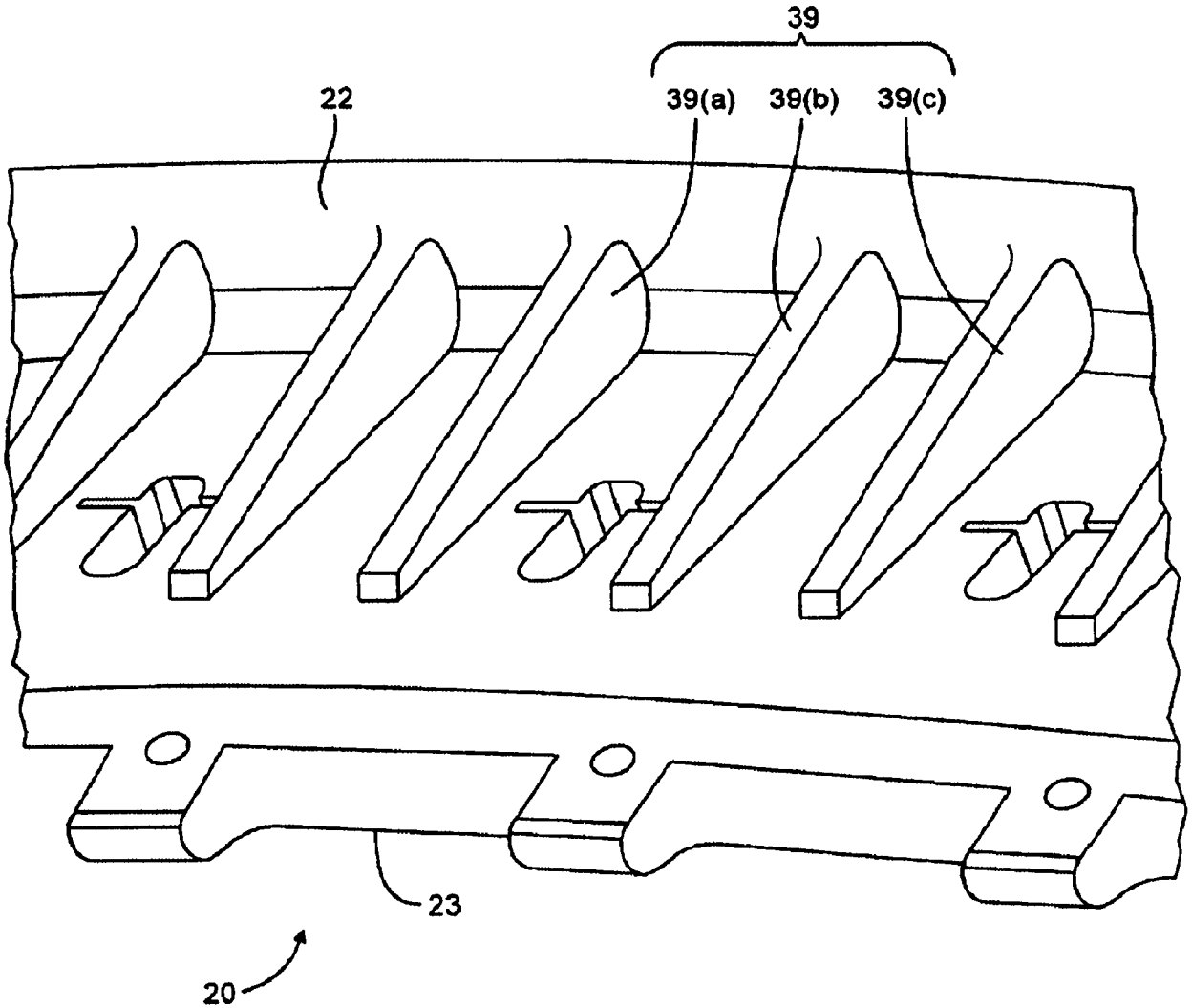
FIG. 5 shows a bottom view of a lip.

A view of the underside of the lip 20 is shown in FIG. 5. FIG. 5 shows a lip 20 and a plurality of stabilizing members 39. As also shown in FIG. 4, pairs of stabilizing members 39(*a*), 39(*b*) are disposed adjacent to, and on opposite sides of, respective holes from the first plurality of holes. As shown in this Figure, the thickness of the stabilizing members 39 decreases in a direction from the rear portion 22 of the lip 20 to the front portion 23 of the lip 20.

Figure 6:
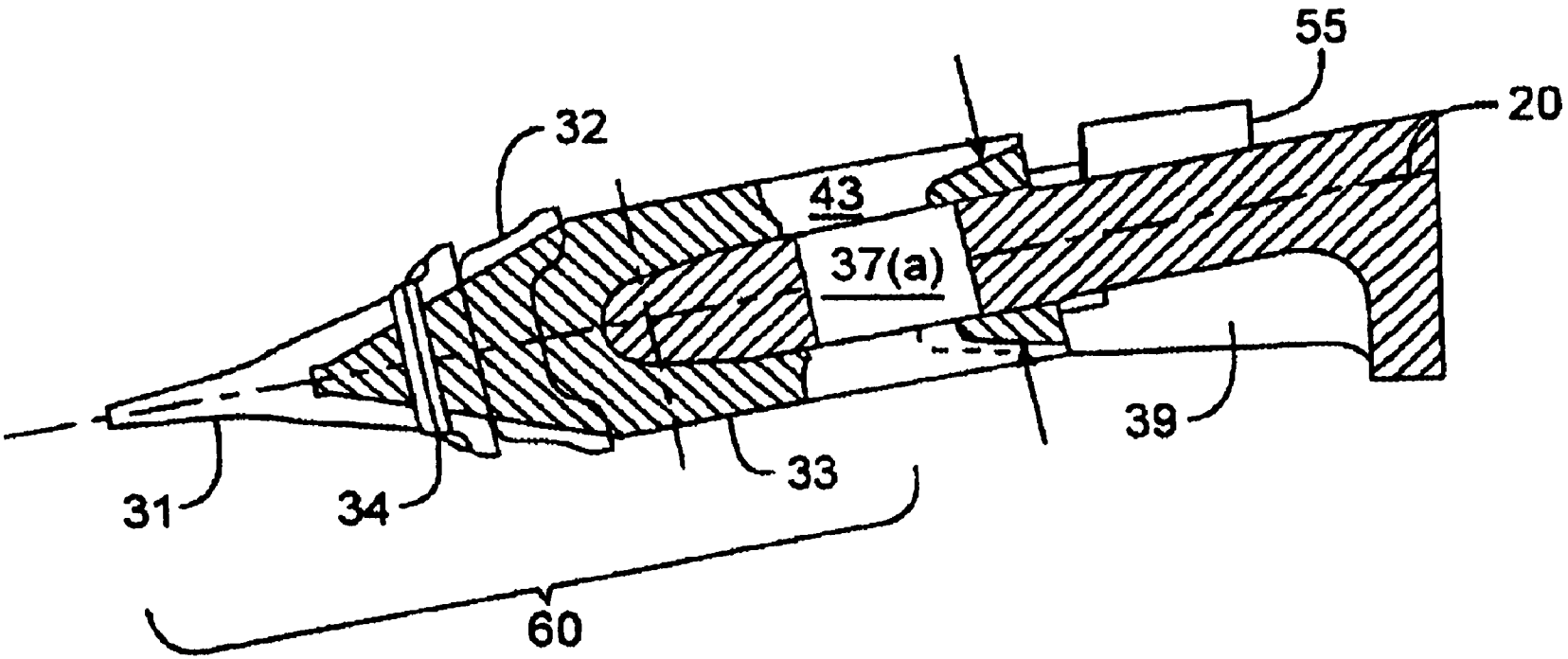
FIG. 6 shows a cross-sectional view of a tooth assembly on a lip.

FIG. 6 shows a side cross-sectional view of a tooth assembly 60 disposed over a lip 20. An adapter 33 of a tooth assembly 60 is on a lip 20. A hole 43 in the adapter 33 and a hole 37 of the first plurality of holes in the lip 20 are aligned. A mechanism such as a C-clamp and a wedge (not shown) can be used to secure the adapter 33 and the lip 20 together via the aligned holes 37, 43. An adapter shroud 32 lies over the adapter 33 to protect the adapter 33, and a tooth 31 is disposed over the adapter shroud 32. The adapter shroud 32 is disposed between the tooth 31 and the adapter 33 when the tooth assembly 60 is secured to the lip 20 and extends from the rear portion of the lip 20 to a central region of the lip 20. A pin 34 or other securing mechanism may be used to secure the tooth 31 to the adapter shroud 32. A stabilizing member 39 is shown on the underside of the lip 20. The stabilizing member 39 provides structural support for the lip 39 and also inhibits the lateral movement of the tooth assembly 60 during use. A block element 55 is present at a rear end of the adaptor 33 and can inhibit the movement of the adaptor 33.

Figure 7:
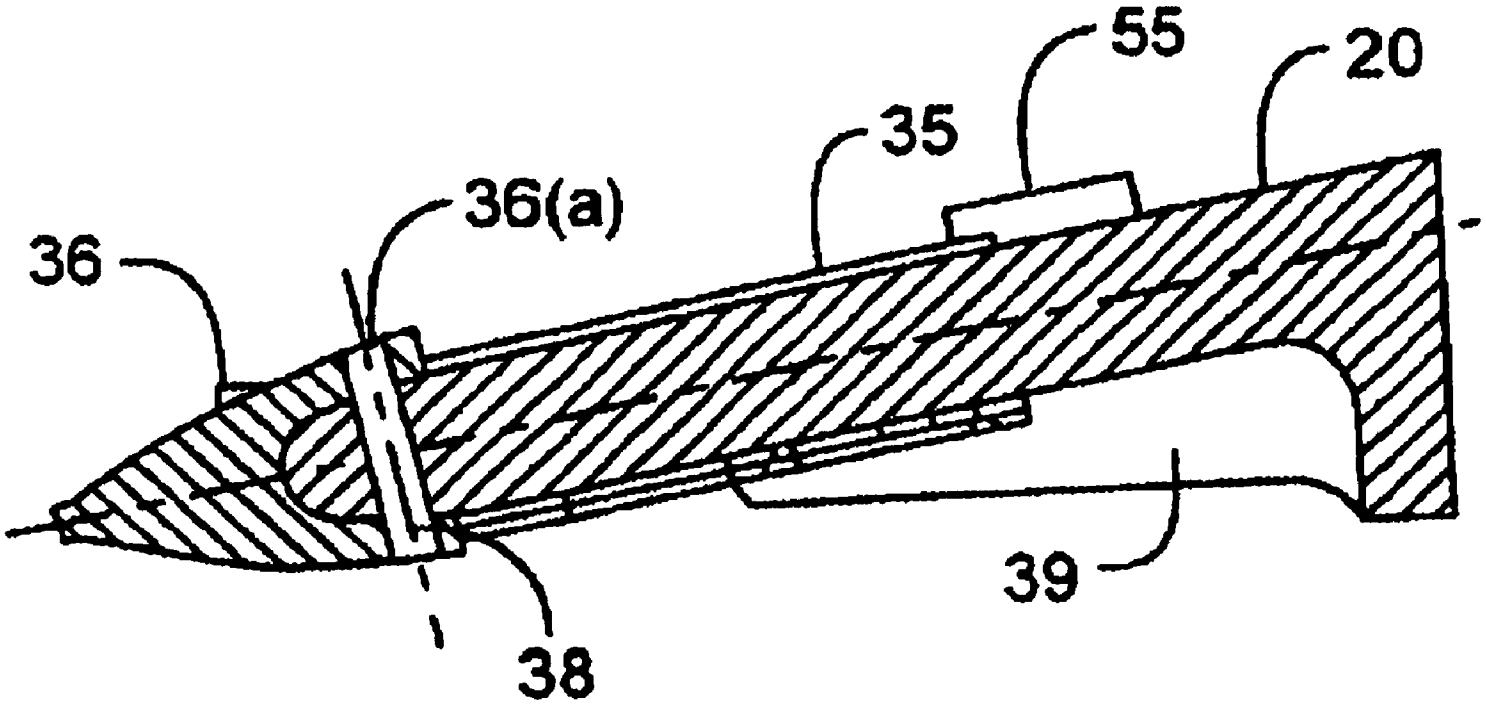
FIG. 7 shows a cross-sectional view of a lip shroud on a front portion of a lip.

FIG. 7 shows a side cross-sectional view of a lip shroud 36 disposed over a lip 20. A hole 36(*a*) in the lip shroud and a lip hole 38 from the second plurality of holes are aligned with each other. A pin (not shown) or other securing mechanism may be disposed within the aligned holes to secure the lip shroud 36 to the lip 20. A wearplate 35 may be disposed on the upper surface of the lip 20 to protect the lip 20 from being worn or damaged by the material being excavated. A stabilizing member 39 is disposed on the underside of the lip 39, and is disposed to a side of the wearplate 35. A block element 55 is present at a rear end of the wearplate 35 and secures the wearplate 35 to the lip 20.

The terms and expressions which have been employed herein are used as terms of description and not of limitation, and there is no intention in the use of such terms and expressions of excluding equivalents of the features shown and described, or portions thereof, it being recognized that various modifications are possible within the scope of the invention claimed. Moreover, any one or more features of any embodiment of the invention may be combined with any one or more other features of any other embodiment of the invention, without departing from the scope of the invention.

All patents and patent applications mentioned above are herein incorporated by reference in their entirety for all purposes. None of them are admitted to be prior art.

What is claimed is:

1. A lip assembly comprising:

a lip having an upper surface, a lower surface, a front portion, a rear portion, a first side portion, a second side portion, corners between the front portion and the first and second side portions, and a plurality of holes disposed between the front portion and the rear portion and extending from the upper surface to the lower surface, wherein the first and second side portions are on opposite sides of the front portion of the lip, and wherein the front portion, the corners, the first side portion, and the second side portion include projections and valleys, the first side portion substantially facing the second side portion;

a plurality of tooth assemblies extending away from at least the front portion of the lip and respectively coupled to the lip via the plurality of holes;

a first plurality of lip shrouds consecutively located and coupled to projections on the first side portion and the corner between the first side portion and the front portion; and a second plurality of lip shrouds consecutively located and coupled to projections on the second side portion and the corner between the second side portion and the front portion, wherein the first plurality of lip shrouds and the second plurality of lip shrouds from an excavating surface at the corners and at the first and second side portions;

wherein the corners between the front portion and the first and second side portions are curved.

2. The lip assembly of claim 1 wherein one or more tooth assemblies of the plurality of tooth assemblies are coupled to each corner of the lip.

3. An excavation bucket assembly comprising:

a bucket body comprising a front portion; and the lip assembly of claim 1 coupled to the bucket body.

4. The lip assembly of claim 1, further comprising a third plurality of lip shrouds, wherein each of the lip shrouds of the third plurality of lip shrouds is coupled to one of the projections on the front portion of the lip and is located between two tooth assemblies of the plurality of tooth assemblies.

5. The lip assembly of claim 1, wherein the first side portion and the second side portion are curved.

6. The lip assembly of claim 1, wherein each of the corners comprises a plurality of valleys, wherein at least one of the plurality of tooth assemblies is coupled to at least one of the plurality of valleys.

7. The lip assembly of claim 1, wherein one of the tooth assemblies comprises an adapter coupled to the lip, an adapter shroud coupled to the adapter, and a tooth coupled to the adapter shroud.

8. The lip assembly of claim 1, further comprising a plurality of support members, wherein one of the tooth assemblies is received between a pair of the plurality of support members.

9. The lip assembly of claim 1, wherein each tooth assembly includes a socket adapted so that the lip can be placed within the socket.

10. The lip assembly of claim 7, wherein the lip is coupled within a socket in the adaptor.

11. The lip assembly of claim 1, wherein each tooth assembly comprises an adaptor having a socket including two opposing flanges, wherein the lip is coupled between the two opposing flanges in the socket of the adaptor.

12. A lip assembly comprising:

a lip having an upper surface, a lower surface, a front portion, a rear portion, a first side portion, a second side portion, corners between the front portion and the first the second side portions, and a plurality of holes disposed between the front portion and the rear portion and extending from the upper surface to the lower surface, wherein the first and second side portions are on opposite sides of the front portion of the lip, wherein the first side portion is substantially facing the second side portion, and wherein the front portion, the first side portion, and the second side portion include projections and valleys; and a plurality of tooth assemblies extending away from at least the front portion of the lip and respectively coupled to the lip via the plurality of holes, wherein each tooth assembly comprises an adaptor having a socket including two opposing flanges, wherein the lip is coupled between the two opposing flanges in the socket of the adaptor a first plurality of shrouds consecutively located and coupled to projections on the first side portion and the corner between the first side portion and the front portion; and a second plurality of shrouds consecutively located and coupled to projections on the second side portion and the corner between the second side portion and the front portion, wherein the first plurality of shrouds and the second plurality of shrouds form an excavating surface at the corners and the first and second side portions.

* * * * *